US010383406B2

(12) United States Patent
Sohnchen et al.

(10) Patent No.: US 10,383,406 B2
(45) Date of Patent: Aug. 20, 2019

(54) ILLUMINATED SAFETY BELT BUCKLE FOR A SAFETY BELT DEVICE OF A MOTOR VEHICLE

(71) Applicant: AUTOLIV DEVELOPMENT AB, Vargarda (SE)

(72) Inventors: Arndt Sohnchen, Hamburg (DE); Iulian Rotariu, Elmshorn (DE)

(73) Assignee: AUTOLIV DEVELOPMENT AB, Vargarda (SE)

( * ) Notice: Subject to any disclaimer, the term of this patent is extended or adjusted under 35 U.S.C. 154(b) by 0 days.

(21) Appl. No.: 15/580,952

(22) PCT Filed: Jun. 8, 2016

(86) PCT No.: PCT/EP2016/062988
§ 371 (c)(1),
(2) Date: Dec. 8, 2017

(87) PCT Pub. No.: WO2016/198432
PCT Pub. Date: Dec. 15, 2016

(65) Prior Publication Data

US 2018/0192744 A1 Jul. 12, 2018

(30) Foreign Application Priority Data

Jun. 8, 2015 (DE) ..... 10 2015 210 450

(51) Int. Cl.
*A44B 11/25* (2006.01)

(52) U.S. Cl.
CPC ..... *A44B 11/2565* (2013.01); *A44B 11/2523* (2013.01)

(58) Field of Classification Search
CPC ..... A44B 11/2565; A44B 11/2523
See application file for complete search history.

(56) References Cited

U.S. PATENT DOCUMENTS

| | | | | |
|---|---|---|---|---|
| 5,892,436 A * | 4/1999 | Blackburn | ..... | A44B 11/2565 180/268 |
| 2007/0236917 A1* | 10/2007 | Gray | ..... | A44B 11/2546 362/108 |
| 2012/0089302 A1 | 4/2012 | Griffin | | |

FOREIGN PATENT DOCUMENTS

| | | |
|---|---|---|
| DE | 39 04 125 A1 | 8/1989 |
| DE | 10 2007 047704 A1 | 4/2009 |
| DE | 20 2012 012254 | 4/2013 |
| DE | 10 2013 003 978 A1 | 9/2014 |
| WO | WO 2016/008585 A1 | 8/1989 |

OTHER PUBLICATIONS

International Search Report of PCT/EP2016/062988, dated Aug. 25, 2016.

* cited by examiner

*Primary Examiner* — Abigail E Troy
(74) *Attorney, Agent, or Firm* — Brinks Gilson & Lione

(57) ABSTRACT

An illuminated belt buckle for a seat belt device of a motor vehicle including a housing (1), a push button (2) displaceable in the housing (1), an insertion slot (12) delimited by an edge section (23) of the housing (1) and the push button (2) for insertion of a belt tongue that can be locked in the belt buckle, and at least one light-emitting surface (13,14). The light-emitting surface (13,14) having a linear contour, the shape of which matches the shaping of a laterally positioned edge side (24) of the push button (2) when viewed toward the insertion slot (12).

13 Claims, 2 Drawing Sheets

ILLUMINATED SAFETY BELT BUCKLE FOR A SAFETY BELT DEVICE OF A MOTOR VEHICLE

CROSS-REFERENCE TO RELATED APPLICATIONS

This application is a 35 U.S.C. § 371 national phase application of PCT International Application No. PCT/EP2016/062988, filed Jun. 8, 2016, which claims the benefit of priority under 35 U.S.C. § 119 to German Patent Application No. 10 2015 210 450.8, filed Jun. 8, 2015, the contents of which are incorporated herein by reference in their entirety.

FIELD OF THE INVENTION

The present invention concerns an illuminated belt buckle for a seat belt device of a motor vehicle.

BACKGROUND

Belt buckles for seat belt devices of motor vehicles generally function to lock securely to the vehicle a belt tongue (or "latch plate") that is held and slides along a belt strap (or "webbing") or is firmly connected to one end of a belt strap. For this purpose, the seat belt buckle includes an insertion slot for the belt tongue and a locking mechanism that can be released via a push button. The locking mechanism is spring-loaded and locks the belt tongue automatically when it is pushed into the insertion slot. To release the belt tongue, the occupant presses down on the push button, releasing the locking mechanism and ejecting the tongue by a force produced by the spring in the locking mechanism.

Such seat belt buckles have long been prior art. A problem with such belt buckles is that to fasten it, the occupant must locate the relatively narrow insertion slot of the buckle, into which he or she inserts the belt tongue to fasten the seat belt.

From DE 39 04 125 (A1) it is known to provide a light source on the buckle that is coupled to predetermined light-emitting surfaces of the buckle via a light-conducting material. Here the light-emitting surfaces are the push button itself and an emitting surface disposed on a lateral surface of the insertion slot opposite the push button. Since the push button must be embodied movable in order to function, the light-conducting material fixedly disposed in the push button must be positioned in the push button such that the surface where the light enters the fiber-optic material when the push button is in the non-depressed position will be connected by lighting technology to the external light source. If, in this position, the light entry surface of the fiber-optic material is not connected to the external light source by lighting technology because of production-related shape deviations or mechanical influences, the light will not, or will incompletely, be guided into the push button, causing the push button itself not to illuminate or to illuminate more weakly than desired.

From DE 10 2007 047 704 (A1), it is also known to provide the seat belt buckle with a light guide that includes at least two light-emitting surfaces disposed at the ends of the insertion slot. The light-emitting surfaces themselves are formed triangular and are disposed in a free triangular surface of the front side of the housing between the edge of the housing and a conical lateral surface of the push button. This way the light-emitting surfaces in particular are dimensioned so that they fill the free surfaces as fully as possible at the corners of the front side of the housing so as to achieve the greatest possible luminosity.

The object of the present invention is to provide an illuminated seat belt buckle of the above-described type that will make it very easy to locate the buckle and the push button for the fastening and unfastening actions.

To achieve this object, an illuminated belt buckle having the features described herein is proposed. Additional preferred embodiments of the invention can be found in the Figures, and the associated descriptions.

According to a feature of the present invention, it is proposed that the light-emitting surface on the seat belt buckle has a linear contour, with its shape matching the shape of an edge side of the push button disposed laterally in the direction of the insertion slot.

The advantage of the proposed solution is the fact that locating the buckle and especially the push button is simplified, first, by the very fact of illumination. Second, the position of the push button is further characterized by the shaping of the light-emitting surface, so that locating and operating the push button are simplified. In this way the occupant is able to locate the push button simply by the position of the luminous light-emitting surface alone, after operating it several times and achieving a certain level of practice, and in knowing the position of the light-emitting surface at the edge of the push button. In the simplest case, after a certain amount of practice, the occupant can release the buckle by pressing "blindly" on the surface next to the light-emitting surface without having to recognize the push-button itself. In this case, operating the push button is made easier by the fact that the seat belt buckle, both in the normal fastened position and in the unloaded or unfastened position, has a basic orientation in which the push button is always positioned on the same side of the light-emitting surface. Since the insertion slot in turn is always disposed in a fixed orientation with respect to the push button, this also lets the slot be located easily in order to fasten the seat belt.

SUMMARY AND INTRODUCTORY DESCRIPTION OF THE INVENTION

According to a preferred further development of the present invention, it is proposed that the light-emitting surface extend to one of the ends of the insertion slot. Due to the solution proposed, the occupant will be able to locate the insertion slot particularly easily, knowing the position of the light-emitting surface after reaching a certain level of practice, by mentally extending the light-emitting surface and inserting the belt tongue accordingly at that point in the mentally extended position. Furthermore, the insertion slot will thereby be illuminated intentionally at one end, so that the insertion slot itself will be more readily visible for the occupant.

When this is done, locating it can be simplified especially by the fact that the light-emitting surface has a width identical to or smaller than that of the insertion slot. The luminous light-emitting surface thus has a width that is identical to or even narrower than that of the insertion slot, and so the occupant will easily be able to position the belt tongue in its transverse orientation to be fastened, by lining up the belt tongue approximately along the mentally lengthened portion of the light-emitting surface. Because of the proposed width of the light-emitting surface, the belt tongue is then positioned in the transverse direction of the insertion slot, over the insertion slot, and then simply has to be inserted.

Further, it is preferable to provide two light-emitting surfaces on the seat belt buckle, which are disposed on different, opposite edge sides of the push button. The push button is thereby framed on both sides by the two light-emitting surfaces, and so the position of the push button between the light-emitting surfaces is clearly defined and can therefore be located particularly easily, given the luminous light-emitting surfaces. To do this, the push button proper does not have to be identifiable; the occupant simply needs to press his finger on the surface situated between the luminous light-emitting surfaces to release the belt tongue and initiate the unfastening action.

In this case, the light-emitting surfaces can preferably be designed symmetrical with respect to a center axis of the push button. In addition to the visually appealing general impression that results, the push button, indeed the whole buckle, can thereby be illuminated very evenly. When this is done, the light-emitting surfaces will preferably be identical in size and shape, so that the light emanating from the light-emitting surfaces will be identical in the intensity and distribution of its illumination alongside an identical luminous power, appropriate for the area, of the light-emitting surfaces.

The insertion slot may also have a shorter length than the width of the push button, oriented parallel to the longitudinal extension of the insertion slot, and the light-emitting surfaces on the edge sides of the push button may be designed to converge towards the ends of the insertion slot. Accordingly, the insertion slot is intentionally shorter than the width of the buckle, so that when the insertion slot is accordingly placed midway between the ends of the insertion slot and the edge of the housing, there is a gap in the longitudinal direction of the insertion slot. This gap is now occupied by the light-emitting surfaces positioned inside. As a result, the light-emitting surfaces in these sections converge and effectively point in the direction of the insertion slot, simultaneously framing the push button. Because of this, both the push button to be operated and the position of the insertion slot are rendered more identifiable. If the light-emitting surfaces converge at an oblique angle, for example, the two luminous light-emitting surfaces visibly form an arrow, either with its blunt end formed by the insertion slot, or else pointing to the side of the push button at which the insertion point is positioned.

Doing this will make it possible for the light-emitting surface to extend to the ends of the insertion slot and contain the insertion slot between them. The insertion slot thereby forms an imaginary connection between the light-emitting surfaces so that it can be located quite easily after corresponding practice by the occupant.

In addition, the light-emitting surface may preferably be disposed on a light-conducting component that is affixed firmly to the housing. The proposed solution is preferred in this instance because the light source itself can thereby be positioned at a location independent of the light-emitting surface.

Here the light-conducting component may preferably include an attachment section affixed to a wall of the housing and an input-coupling section projecting into a cavity positioned within the housing, with the light-emitting surfaces being situated on the attachment section and on the input-coupling section of a light-entry surface. Due to the proposed solution, the light-conducting component can be affixed quite easily to the seat belt buckle, with the light-conducting section being inserted with the attachment section in a corresponding recess of the housing or molded in a 2K molding or spraying process of the plastic of the housing in the vicinity of the attachment section. At the same time, the attachment section is used by the light-emitting surface arranged on it for output coupling of the light coming from the light-conducting component. This makes the positioning of the light-emitting surface on the attachment section particularly beneficial because the light-emitting surface is thereby attached especially well in relation to the housing and is positioned very precisely with respect to the housing. The fiber-optic component is thereby attached with the section displaying the light-emitting surface almost directly opposite the housing. The input-coupling section then functions for input coupling of the light into the fiber-optic component, due to the light-entry surface positioned on it.

In this case, the light-conducting component can also be attached across from the housing with the light-conducting component being shaped in such a way that it rests with its input-coupling section, at least sectionally flat against an inner wall of the housing. In this way the light-conducting component is further supported laterally, facing the housing in the region of the input-coupling section.

Here, the light-emitting surface is preferably larger than the light-entry surface. This effectively widens the light in the light-conducting component and distributes it over a larger area. As a result, a larger illuminated area can be created to identify the push button and the insertion slot. This reduces the light density of the light-emitting surface in relation to the light density of the luminous flux that goes into the light-entry surface, but this is acceptable because the luminous flux emerging from the light-emitting surface functions solely to identify the push button or the insertion slot and not to illuminate the surroundings. Furthermore, the attachment section including the light-emitting surface that is placed on it can thereby be made larger in the embodiment, and the fiber-optic component can thereby be attached to the housing very precisely and stably.

Here, the light-conducting component, proceeding from the light-entry surface in the direction of the light-emitting surface, can be shaped to widen conically, which will cause the luminous flux in the fiber-optic component to broaden as homogeneously as possible. Here it is sufficient for the light-conducting component to be shaped as a cone in a segment between the light-entry surface and the light-emitting surface in its basic shape.

The light-conducting component may preferably be created from a plastic part that is stable in shape and transparent to light. Examples of such plastics are polycarbonate or PMMA. With the proposed solution, the light-conducting component can be produced very inexpensively. Besides, it can be manufactured to have a complex shape with a sufficient stability of shape to be attached readily and shaped in correspondence with the shape of the light emission that must be realized.

The light source can also be preferably connected to the light-conducting component via a light guide, so that the light source can be secured to the seat belt buckle at a greater distance from the light-conducting component and, in particular, at a location favorable for attachment and for electrical contacts, independent of both the location the light-conducting component and, in particular, the location of the light-emitting surface.

Here, the light guide may include one light-entry surface oriented toward the light source and two light-exit surfaces separated from each other, with each of the light-exit surfaces oriented toward a light-entry surface of a light-conducting component. Using the solution suggested, the light that is coupled into the light guide is distributed to two light-exit surfaces and from these is coupled into the two light-conducting components. Thus the light guide effectively forms a branch of the luminous flux emanating from the light source. This means a single light source can be used to illuminate both light-emitting surfaces of the light-conducting component. If additional light-emitting surfaces are to be provided on the seat belt buckle, they can be coupled to the luminous flux of the light source by additional fiber-optic light guides or by further splitting inside the light guide.

Specifically, the light guide, proceeding from the light-entry surface, may preferably be split into two branches separated from each other, one light-exit surface being assigned to one branch in each instance. The branches of the light guide function to conduct the two luminous fluxes separately, separated from each other after being split, to the light-entry surfaces of the fiber-optic light guide. This enables the branches of the light guide to be shaped in any manner and shifted around at will, thanks to the flexible light guide design in the seat belt buckle, depending on the available space.

BRIEF DESCRIPTION OF THE DRAWINGS

The invention is explained below on the basis of preferred embodiments with reference to the accompanying Figures.

DETAILED DESCRIPTION

Figure 1:
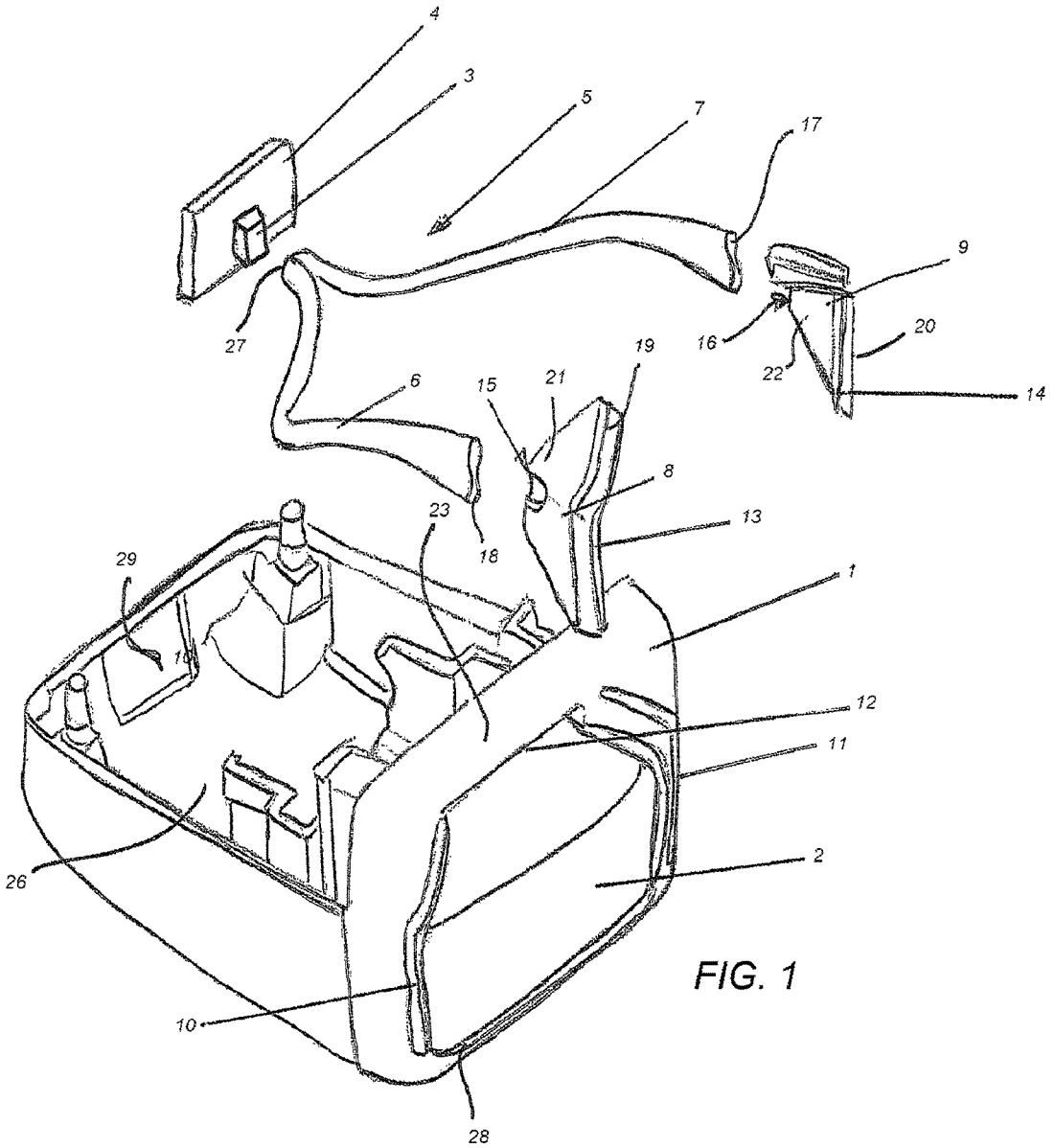
FIG. 1 shows a housing of a seat belt buckle with two light-emitting surfaces in an oblique view.

In FIG. 1, half of a housing 1 of a seat belt buckle can be seen in a seat belt installation for a vehicle. In the housing 1, a push button 2 is provided, which is movably guided in the housing 1 and accessible through an opening 28 on the front face of the housing 1. In the housing 1, there is also a locking mechanism, not displayed for the sake of the overview, that can be released by pressing the push button 2 down or else inserting the push button 2 into the housing 1. The half of the housing 1 to be identified is completed, after the locking mechanism is assembled, by a second half not shown so that the locking mechanism is surrounded by the housing 1 on all sides.

The push button 2 and the opening 28 of the housing 1 are dimensioned such that between the push button 2 and an edge section 23 of the housing 1, an insertion slot 12 is present, into which a belt tongue of the seat belt buckle can be inserted to lock the locking mechanism of the belt buckle. The insertion slot 12 is thereby bounded laterally by the push button 2 on one side and by the edge section 23 of the housing 1 on the other side, as can also be seen in FIGS. 2 and 3. The length L of the insertion slot 12 is dimensioned shorter than the width B of the push button 2 along the longitudinal direction of the insertion slot 12, while the insertion slot 12 is positioned approximately centrally with respect to the push button 2, so that the push button 2 projects over the insertion slot 12 in the longitudinal direction in both directions. Laterally with respect to the push button 2 in the housing 1, two slots 10 and 11 are provided presenting a path that follows the path of the adjacent edge sides 24 and 25 of the push button 2 (see FIGS. 2 and 3). The shape of the opening 28 in the housing 1 corresponds, at least approximately, to the cross-sectional shape of the push button 2, so that the slots 10 and 11 also run parallel to the edges of the housing 1 that form the opening 28. In addition, on the side facing away from the opening 28 of the half of the housing 1, a mounting 29, open on one side, is provided, to which a support plate 4 can be attached with a light source 3 attached to it in the form of an LED. In addition to the light source 3, various memory and computation modules can be provided on the support plate 4 for controlling the light source 3 and/or processing additional signals, such as a seat belt buckle switch.

Furthermore a fiber-optic light guide 5 and two fiber-optic components 8 and 9 are provided in the housing 1. The fiber-optic components 8 and 9 are made of a plastic that is stable in shape and transparent to light, such as polycarbonate or PMMA, with light-conducting properties, and they each include an attachment section 19 and 20 and an input-coupling section 21 and 22. The attachment sections 19 and 20 in their cross-sectional shape are formed to correspond to the shaping of the slots 10 and 11, so that the fiber-optic components 8 and 9 with the attachment sections 19 and 20 can each be inserted from the interior of the housing 1 into one of the slots 10 and 11. Alternatively, however, the light-conducting components 8 and 9 can be molded in a 2K molding or spraying process using the plastic of the housing 1. When this is done, during the transition from the attachment sections 19 and 20 to the input-coupling sections 21 and 22, the light-conducting components 8 and 9 display a step that limits the insertion depth of the fiber-optic components 8 and 9 with the attachment sections 19 and 20 into the slots 10 and 11. The insertion depth of the attachment sections 19 and 20, limited by the step, is dimensioned here such that the front side of the attachment sections 19 and 20 in the fastened position with the adjacent surface of the housing 1 forms a homogeneous upper surface on the outside, free of any steps. The outer sides of the input-coupling sections 21 and 22 of the light-conducting components 8 and 9 are further shaped so that the fiber-optic components 8 and 9 in the fastened position rest on the side against the inner wall of the housing 1 and are thus additionally secured. The attachment sections 19 and 20 are formed in their cross-section so that they fill the slots 10 and 11 completely without any gaps. The fiber-optic components 8 and 9 are provided at the front faces of the input-coupling sections 21 and 22 with light-entry surfaces 15 and 16 and at the front faces of the attachment sections 19 and 20 with light-emitting surfaces 13 and 14.

The fiber-optic light guide 5 includes a light-entry surface 27 which faces the light source 3 in the fastened position of the fiber-optic light guide 5, so that the light emitted from the light source 3 enters the fiber-optic light guide 5. Proceeding from the light-entry surface 27, the light emitted by the light source 3 is first passed along in an initial section of the fiber-optic light guide 5 to a branching point in which the fiber-optic light guide 5 splits into two branches 6 and 7. The light is then forwarded along the branches 6 and 7 respectively up to light-exit surfaces 17 and 18 at the front faces of the branches 6 and 7. Branches 6 and 7 are so dimensioned and flexible on their own that they can be laid out in the cavity 26 of the housing 1 along a bent path in accordance with whatever installation space conditions are available. In this case, the branches 6 and 7 are dimensioned in length and laid out in such a way that the light-exit surfaces 17 and 18 at the front faces of the branches 6 and 7 face the light-entry surfaces 15 and 16 of the input-coupling sections 21 and 22. The light emitted by the light source 3 is thus initially introduced into the light guide 5 through the light-entry surface 27, then forwarded on through the branches 6 and 7 to the light-exit surfaces 17 and 18. From the light-exit surfaces 17 and 18 the light is introduced through the light-entry surfaces 15 and 16 into the light-conducting components 8 and 9 and finally emitted via the light-emitting surfaces 13 and 14 of the attachment sections 19 and 20. The light-entry surfaces 27, 15, and 16 as well as the light-exit surfaces 17 and 18 and the light-emitting surfaces 13 and 14 may be created as surfaces roughened by an appropriate surface treatment, which may be realized by such methods as chemical etching or mechanical processing. The proposed solution of using a central light source 3, a light guide 5, and the two light-conducting components 8 and 9 has the advantage that the light source 3 with the support plate 4 can be positioned at a convenient location for being held in place and making contact, and that the light can be passed via the fiber-optic light guide 5 and the fiber-optic components 8 and 9 to a predetermined location and emitted there. In this way the placement of the light source 3 and the position of the light-emitting surfaces 13 and 14 can practically be selected independently of one another. Alternatively, the light-emitting surfaces 13 and 14 may also be created by self-illuminating, electrically activated films or by gas-filled light sources.

Figure 3:
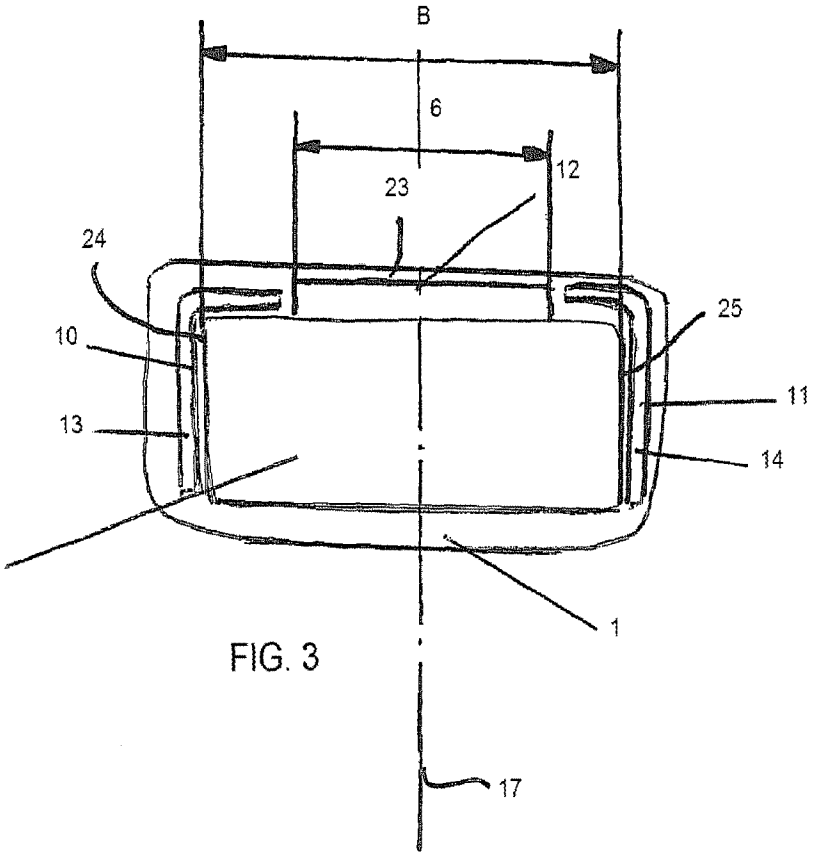
FIG. 3 shows a housing with two light-emitting surfaces in a second embodiment, viewed toward the insertion slot.
Figure 2:
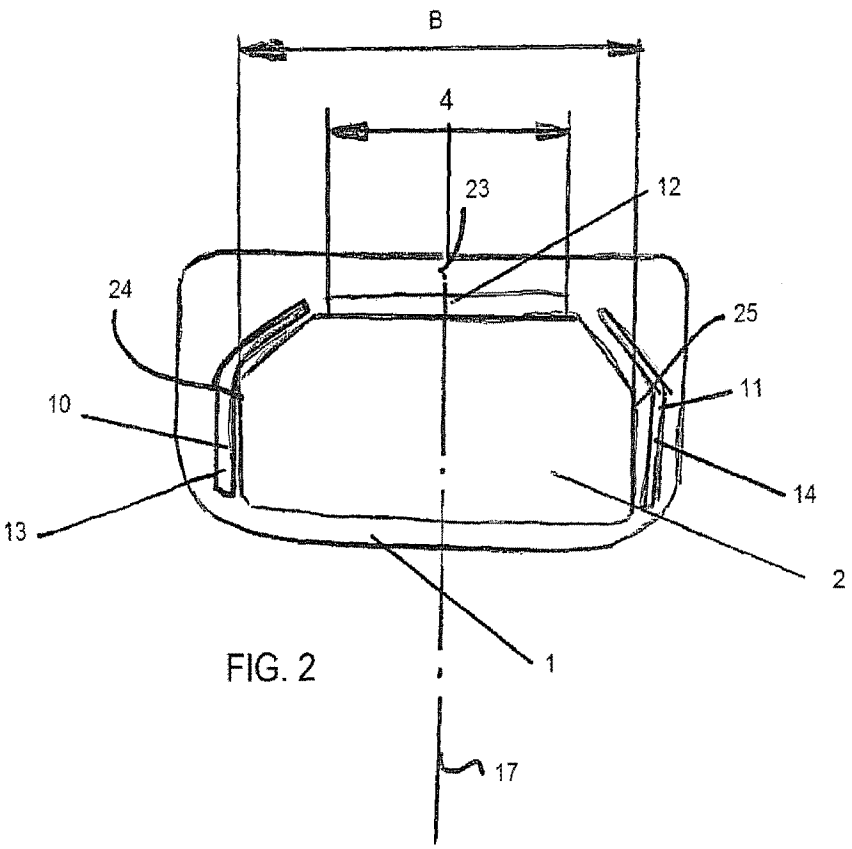
FIG. 2 shows a housing with two light-emitting surfaces in an initial embodiment, viewed toward the insertion slot.

The light-emitting surfaces 13 and 14 are formed linearly and present a path matching that of the adjoining edge sides 24 and 25 of the push button, as can be recognized in FIGS. 2 and 3. The light-emitting surfaces 13 and 14 extend to the ends of the insertion slot 12 and contain the insertion slot 12 between them. The light-emitting surfaces 13 and 14 and the insertion slot 12 thereby effectively form a line encompassing the push button 2 on three sides. In so doing, the light-emitting surfaces 13 and 14 preferably have a width identical to or smaller than the insertion slot 12, so that the occupant encounters the insertion slot 12 with the belt tongue in each case whenever he or she positions the belt tongue with the front side over a position connecting the light-emitting surfaces 13 and 14 with each other and then moves in the direction of the seat belt buckle. Furthermore, the light-emitting surfaces 13 and 14 contain the front surface located in the opening 28 of the housing 1 through the push button 2, so that the occupant can very easily encounter the push button 2 even in the dark, simply by pressing on the surface between the light-emitting surfaces 13 and 14.

In FIG. 2 the push button 2 has a shape conically tapering on one side in the direction of the insertion slot 12. Thus the edge sides 24 and 25 are shaped so that they converge in the direction of the insertion slot 12. The slots 10 and 11 and the light-emitting surfaces 13 and 14 of the light-conducting components 8 and 9 that are set into them are aligned approximately parallel to the edge sides 24 and 25 and therefore also run in the direction of the insertion slot 12. Thus, the light-emitting surfaces 13 and 14 together form an arrow shape pointed in the direction of the insertion slot 12. Furthermore, the light-emitting surfaces 13 and 14 extend in the direction of the insertion slot 12 almost as far as its ends, so that they optically guide the user to the insertion slot 12.

FIG. 3 shows an alternative embodiment of the invention in which the push button 2 has a rectangular cross-sectional shape. The slots 10 and 11 and the light-emitting surfaces 13 and 14 situated in them are also created running parallel to the nearest edge sides 24 and 25 of the push button 2. The slots 10 and 11 and the light-emitting surfaces 13 and 14 each extend around a corner of the push button 2 and exhibit an L-shape in which they are disposed such that two of the legs are parallel to each other and two of the legs are oriented toward each other. Here the light-emitting surfaces 13 and 14 encompass the two lateral edge sides 24 and 25 and the two sections adjacent to the insertion slot 12 of the edge side facing the insertion slot 12 of the push button 2. Since the insertion slot 12 has a shorter length L than the width B of the push button 2 oriented in this direction, the push button 2 projects beyond the insertion slot 12 past its ends. Thus, the light-emitting surfaces 13 and 14 converge in the direction of the ends of the insertion slot 12 thereby framing the push button 2, which makes it particularly well-marked optically.

Both embodiments have in common the fact that the actuating surface of the push button 2, plus the insertion slot 12, the front side of the housing 1, and the light-emitting surfaces 13 and 14 are shaped and oriented symmetrically with respect to a central axis M running through the middle of the insertion slot 12 and the middle of the push button 2.

While the above description constitutes the preferred embodiment of the present invention, it will be appreciated that the invention is susceptible to modification, variation and change without departing from the proper scope and fair meaning of the accompanying claims.

The invention claimed is:

1. An illuminated belt buckle for a seat belt device of a motor vehicle, comprising, a housing, a push button displaceable in the housing, an insertion slot delimited by an edge section of the housing and the push button for insertion of a belt tongue that can be locked in the belt buckle, first and second light-emitting surfaces, the light-emitting surfaces have a linear contour, the shape of which matches the shape of a laterally positioned edge side of the push button viewed toward the insertion slot, wherein one of the light-emitting surfaces is formed on each of two light-conducting components fastened to the housing, each of the light-conducting components having a light-entry surface, a light source communicating with the light-conducting components via at least one fiber-optic light guide coupled for light transmission to the light-emitting surfaces, the light-conducting components proceed from the light-entry surfaces to widen toward the light-emitting surfaces, the at least one fiber-optic light guide presents at least one light-input surface associated with the light source and forms two light-exit surfaces separated from each other, with each of the two light-exit surfaces communicating for light transmission with the light-entry surfaces of the light-conducting components.

2. The illuminated belt buckle according to claim 1, wherein, the two light-emitting surfaces extend to an end of the insertion slot.

3. The illuminated belt buckle according to claim 2, wherein, the light-emitting surfaces have a width identical to or less than that of the insertion slot.

4. The illuminated belt buckle according to claim 1, further comprising a second laterally positioned edge side, the light-emitting surfaces being disposed on different of the laterally positioned edge sides of the push button.

5. The illuminated belt buckle according to claim 4, wherein, the light-emitting surfaces are formed symmetrically with respect to a central axis of the push button.

6. The illuminated belt buckle according to claim 4, wherein, the insertion slot has a shorter length than a width of the push button, the width oriented parallel to a longitudinal extension of the insertion slot of the push button, and each of the light-emitting surfaces on the laterally positioned edge sides of the push button are formed to have portions converging toward each other toward the insertion slot.

7. The illuminated belt buckle according to claim 4, wherein, the light-emitting surfaces extend to an end of the insertion slot, with the insertion slot extending between the two light-emitting surfaces.

8. The illuminated belt buckle according to claim 4, wherein, the light-emitting surfaces on the edge sides of the push button further have generally parallel portions along the laterally positioned edge sides of the push button.

9. The illuminated belt buckle according to claim 1, wherein, the light-conducting components include an attachment section affixed to a wall of the housing and an input-coupling section projecting into a cavity within the housing.

10. The illuminated belt buckle according to claim 9, wherein, the light-conducting components are formed to rest with the input-coupling section, at least sectionally, flat against the wall of the housing.

11. The illuminated belt buckle according to claim 9, wherein, the light-emitting is surfaces are formed larger than at least one of the light-entry surfaces.

12. The illuminated belt buckle according to claim 1, wherein, the light-conducting components are formed from a plastic part that is stable in shape and transparent.

13. The illuminated belt buckle according to claim 1, wherein, the at least one fiber-optic light guide splits proceeding from the at least one light-entry surface into two branches separated from each other, and each of the light emitting surfaces is associated with one of the branches.

* * * * *